US011441388B2

(12) United States Patent
Wang

(10) Patent No.: US 11,441,388 B2
(45) Date of Patent: Sep. 13, 2022

(54) METHODS AND SYSTEMS FOR A FLOW ACTIVATED ANNULUS CHOKE DEVICE

(71) Applicant: Sharp-Rock Technologies, Inc., Cypress, TX (US)

(72) Inventor: Hong Wang, Cypress, TX (US)

(73) Assignee: Sharp-Rock Technologies, Inc., Cypress, TX (US)

( * ) Notice: Subject to any disclaimer, the term of this patent is extended or adjusted under 35 U.S.C. 154(b) by 105 days.

(21) Appl. No.: 17/075,413

(22) Filed: Oct. 20, 2020

(65) Prior Publication Data

US 2021/0131223 A1 May 6, 2021

Related U.S. Application Data

(60) Provisional application No. 62/982,958, filed on Feb. 28, 2020, provisional application No. 62/930,526, filed on Nov. 4, 2019.

(51) Int. Cl.
*E21B 34/08* (2006.01)

(52) U.S. Cl.
CPC ..... *E21B 34/08* (2013.01); *E21B 2200/02* (2020.05)

(58) Field of Classification Search
CPC ..... E21B 34/08; E21B 2200/02; E21B 34/10; E21B 34/06; E21B 34/14; E21B 34/142; E21B 34/02
See application file for complete search history.

(56) References Cited

U.S. PATENT DOCUMENTS 2,047,774 A * 7/1936 Greene ..... E21B 33/136 102/304
4,417,625 A * 11/1983 Henson ..... E21B 33/134 166/387
6,966,373 B2 * 11/2005 Von Gynz-Rekowski ..... E21B 33/12 251/5

* cited by examiner

*Primary Examiner* — Abby J Flynn
*Assistant Examiner* — Nicholas D Wlodarski
(74) *Attorney, Agent, or Firm* — Pierson Intellectual Property LLC

(57) ABSTRACT

Systems and methods for a flow activated choke device that is activated by the choke device directly interacting with the flow of fluid in an upstream direction. More specifically, a choke device formed of chain like materials that is configured to be extended in a first mode and compacted in a second mode, wherein the choke device moves from the first mode to the second mode responsive to an upward fluid flow rate being greater than a flow rate threshold.

14 Claims, 10 Drawing Sheets

METHODS AND SYSTEMS FOR A FLOW ACTIVATED ANNULUS CHOKE DEVICE

BACKGROUND INFORMATION

Field of the Disclosure

Examples of the present disclosure relate to systems and methods for a flow activated choke device that is activated by the choke device directly interacting with the flow of fluid in an upstream direction. More specifically, embodiments are directed towards a choke device formed of chain like materials that is extended in a first mode and accumulated in a second mode, wherein the choke device moves from the first mode to the second mode responsive to an upward fluid flow rate being greater than a flow rate threshold.

Background

A blowout in an oil and gas well is the uncontrolled release of materials from the well after pressure control systems have failed. Conventional blowout preventers (BOP) include large specialized mechanical devices that are used to seal, control, and monitor pressure levels to prevent blowouts. Typically these large specialized mechanical devices are installed in redundant stacks.

In a typical high pressure well, drill strings are routed through the blowout preventer stack towards the reservoir of oil and gas. As the well is drilled, drilling fluid is fed through a hollow drill sting to a drill bit and returns up the wellbore in the annulus between the drill sting and casing or open hole. When an influx of formation fluid occurs, systems manually close the BOP units. When the BOP are closed, the annulus or the wellbore is sealed to stop the flow of fluid out of the wellbore. Then, denser fluids are circulated into the wellbore down the drill string, up the annulus, and out through a choke line at the base of the BOP stack until pressure is decreased.

In conventional systems, BOP stacks take up a substantial amount of space, and must be mounted on a wellhead at the surface for a land or at a subsea surface for an offshore deep-water well. This creates an exposed hazard. Furthermore, an operator must manually perform tasks to send a signal to close the BOP to contain the fluid flow pressure when a blowout occurs, and manually perform tasks to open the BOP when the pressure within the wellbore has stabilized. This requires continuous monitoring of the wellbore.

Accordingly, needs exist for systems and methods for a choke device formed of that is extended in a first mode and compacted in a second mode, wherein the choke device automatically moves from the first mode to the second mode responsive to an upward fluid flow directly interacting with and moving the choke device and the fluid flow rate being greater than a flow rate threshold.

SUMMARY

Examples of the present disclosure relate to systems and methods for a flow activated choke device that is activated by the choke device directly interacting with the flow of fluid in an upstream direction. More specifically, embodiments are directed towards a choke device formed of chain like materials that is configured to be extended in a first mode and compacted in a second mode, wherein the choke device moves from the first mode to the second mode responsive to an upward fluid flow rate being greater than a flow rate threshold. In embodiments, the choke device may include a wellbore, drill string, stopper, blocking element, and track.

The wellbore may be a hole that is drilled to aid in the exploration and recovery of natural resources, including oil, gas, or water. The wellbore may be encased by materials such as steel, cement, etc.

The drill string may be a column, string, etc. of drill pipe that transmits drilling fluid and/or torque to a drill bit. The drill string may be comprised of various tools to aide in fracturing the wellbore, and used during production. In embodiments, an annulus may be formed between the outer diameter of the drill string and the inner diameter of the wellbore.

The stopper may be a projection, ledge, etc. positioned on the outer diameter of the drill string. The stopper may be configured to secure a proximal end of the blocking element in place. Further, the stopper may reduce the space or size across the annulus between the drill string and the wellbore. However, fluid may still be able to flow through the annulus. In an embodiment, the space or size across the annulus corresponding with the stopper may be less than a link, module, unit, etc. of the blocking element. This relative sizing of the stopper and link may restrict the upper ward movement of the blocking element past the stopper. In embodiments, only those links, etc. close to the stopper may be larger than the space or size across the annulus corresponding with the stopper, and other links below may be smaller. Furthermore, in alternative embodiments, the stopper may be mounted on an inner wall of the wellbore or casing and/or a plurality of stoppers may be used.

The blocking element may be a chain like device that is formed in a serial assembly of connected pieces, called links. The blocking element may be porous when the chains accumulate in an annulus forming a plug. The links may be made out of metal or any other material that can withstand a harsh downhole environment. The blocking element may be flexible and curved in compression and linear, rigid and load bearing in tension. When the blocking element is a chain, the chain may comprise ropes, links, formed of various shapes and sizes, such as rings, ovals, rectangles, squares, spherical, etc., wherein the links may have different lengths and widths, such as 1 millimeter to 15 centimeters. The links may be formed of different materials, such as steel, aluminum, alloys, plastics, engineered plastics, rubbers, etc. The blocking element may be further linked together to form a net like shape, especially when multiple chain like materials are attached to the drill string. Other materials may also be attached to the chain like material proximal to the distal end of the blocking element. These materials may comprise rubber sheets, rags, etc., and may be deposited on the surface of a formed plug and help to further reduce the flow. A link of the chain may have a longer length than the space of across the annulus corresponding to the stopper. In embodiments, a proximal end of the blocking element may be coupled to a lower surface of the stopper, and a distal end of the blocking element may be free hanging or coupled to a slide that is configured to move along a linear track. If the distal end of the blocking element is coupled to the slide, a body of the blocking element may be configured to be wrapped around the outer diameter of the drill string in a helical, spiraling, etc. pattern. This spiraling or similar pattern may promote the blocking element to stay with the drill string rather than go away from the drill string toward the inner wall of casing or wellbore due to the centrifugal force when the drill string rotates during normal drilling. This spiraling may allow a more uniform accumulation of the blocking element.

Responsive to a fluid flow rate through the annulus towards the surface directly interacting with the blocking element being greater than a fluid flow threshold, the distal end of the blocking element may move towards the stopper. This movement of the blocking element may accumulate the blocking element, and compact a length of the blocking element. The accumulation of the blocking element may form a plug across the annulus. This plug may be used to seal the annulus to reduce or choke the flow of fluid towards the surface.

When the distal end of the blocking element is coupled to the slide, the slide may move the distal end of the blocking element along a linear path. When the fluid flow rate in the annulus against the blocking element is less than a flow threshold, the blocking element may return to its elongated state via gravity.

Weighted objects may be coupled to a distal end of the blocking element when gravity is not sufficient to maintain the blocking element in the elongated state at rest. Alternatively or in addition, springs may be attached to the blocking element to assist in elongating the blocking element in place, which may be effective in horizontal wells.

The track may be a linear railing system that is configured to extend along the outer diameter of the drill string. The track may be configured to receive the slide to allow a controlled movement of the distal end of the blocking element. In embodiments, the track may extend from the stopper towards a distal end of the drill string.

Alternative methods of a choke device may multiple blocking elements that are formed of one or more skirt like fabric material positioned around the drill string. The skirts may be cylindrical with a larger center diameter than the diameters at the ends of the skirts. The skirts may be formed of fabric, rubber sheets, plastic film, metal wire sheets, etc. In embodiments, a length and largest diameter of the skirt may be determined by the annulus space or size such that the skirt may be large enough to cover the annulus when skirt is in a compact mode.

In embodiments, the skirts may be stretched by weights, springs, etc. or any other device that is configured to apply a force towards a distal end of the wellbore. The weights may be designed that the skirts may hang in a stretched position around the drill string when there is a fluid flow rate through the annulus below a fluid flow threshold. However, when the annulus flow rate increases to be greater than the fluid flow threshold, such as in a blowout situation or caused by pumping rate increase in a completion case, the friction of the flow then can lift the stretched skirts to go upward. When the skirts move upward towards the surface of the wellbore by directly interacting with the fluid flow, the skirts may fold and accumulate at a place where a stopper is installed. When the skirts fold and accumulate enough around the drill string or tubing in the annulus, the fabric like material of the skirt can eventually seal off the annulus. After the annulus flow rate has been controlled and become low, after sealing, pulling the string or tubing will simply let the folded skirts unfolded and stretched again and device back in its open position. In other embodiments, the skirts may be opened by pumping down fluid into the annulus to push the folded skirt down to unfold the skirts.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
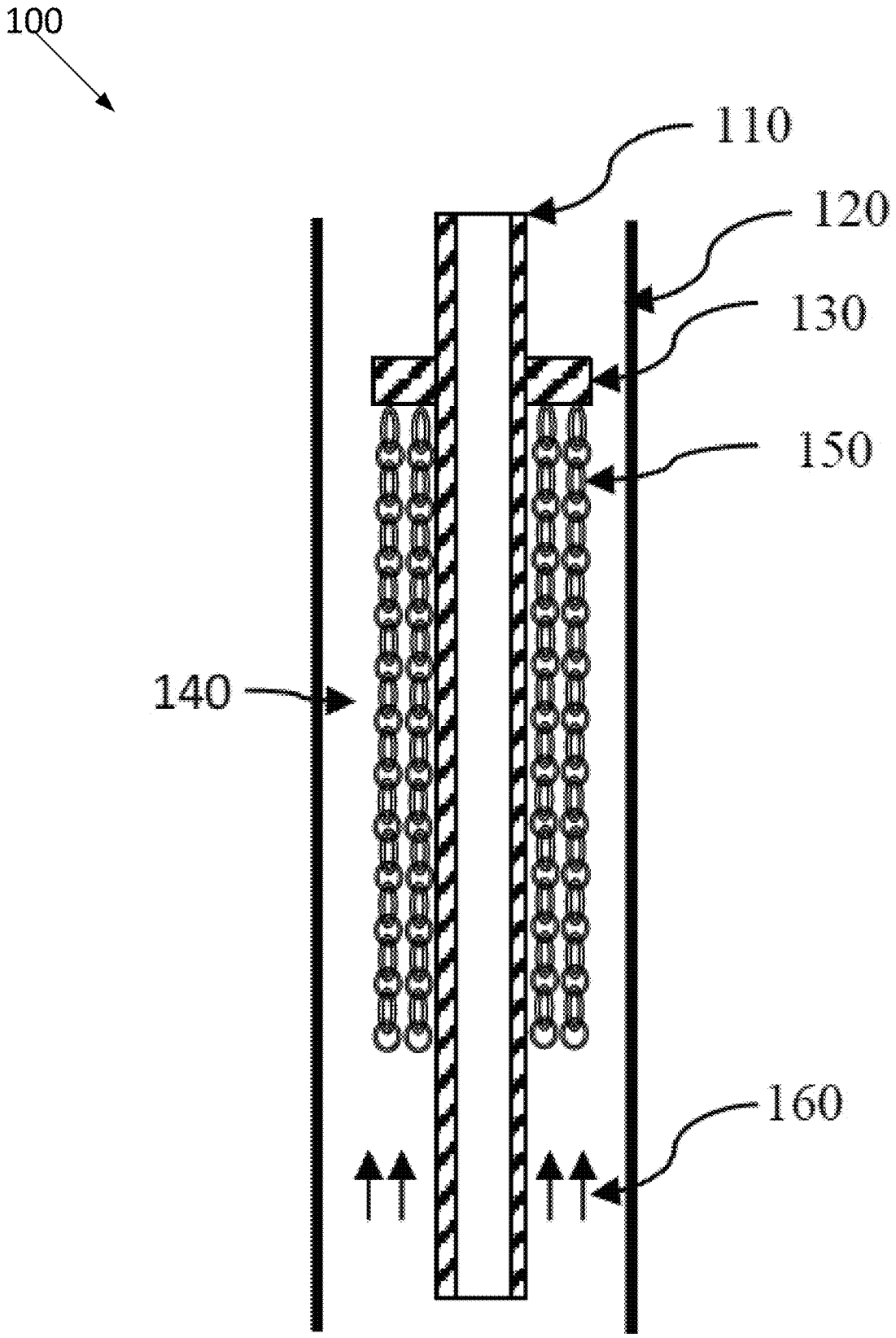
FIG. 1 depicts a flow activated choke system 100, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a flow activated choke system 100, according to an embodiment. Choke system 100 may be configured to form a seal, a porous closure, etc. within an annulus in a wellbore. Choke system 100 may include a drill string 110, wellbore 120, stopper 130, annulus 140, and blocking element 150.

Drill string 110 may be a column, tubing, string, etc. of drill pipe that transmits drilling fluid and/or torque to a drill bit. Drill string 110 may be comprised of various tools to aide in drilling the wellbore 120, or used during production.

Wellbore 120 may be a hole that is drilled to aid in the exploration and recovery of natural resources, including oil, gas, or water. Wellbore 120 may be encased by materials such as steel, cement, etc.

Stopper 130 may be a projection, ledge, etc. positioned on the outer diameter of drill string 110. Stopper may reduce the space across the annulus 140 between the drill string 110 and wellbore 120, while allowing the fluid to flow through the annulus 140. The space across the annulus corresponding with the stopper may be less than at least one module, link unit, etc. of the blocking element 150. This sizing may restrict the upper ward movement of the blocking element 150 past stopper 130. Furthermore, in alternative embodiments, stopper 130 may be mounted on an inner diameter of the wellbore or casing. In embodiments, a plurality of stoppers may be used. Stopper 130 may be configured to secure a proximal end of blocking element 150 in place.

An annulus 140 may be formed between the outer diameter of drill string 110 and inner diameter of wellbore 120. Annulus 140 may be variable along a longitudinal axis of choking device system 100 based on the geometric properties of stopper 130 and/or the orientation of blocking element 150.

Blocking element 150 may be a chain like device that is formed in a serial assembly of connected pieces, called links. The links may be made out of metal or any other material that can withstand a harsh downhole environment. Blocking element 150 may be flexible and curved in compression and linear, rigid and load bearing in tension. A link of blocking element 150 may have a longer width and/or length than a space or size of across the annulus corresponding to the stopper 150. As such, blocking element 150 may be restricted from moving above stopper 130. A proximal end of blocking element 150 may be fixed in place and be coupled to a lower surface of stopper 130. A distal end of blocking element 150 may be configured to move towards a proximal end of the wellbore to be compacted in a first mode, and to elongate towards a distal end of the wellbore to be extended in a second mode. The distal end of blocking element 150 may be free hanging or coupled to a slide that is configured to move along a linear track. If the distal end of the blocking element 150 is coupled to the slide, a body of the blocking element 150 may be configured to be wrapped around the outer diameter of drill string 110 in a helical, spiraling, etc. pattern. This pattern may assist in the accumulation of blocking element 150, control the motion of blocking element 150 and keep the blocking element 150 to the drill string 110 against the centrifugal force when the drill string rotates. When the distal end of the blocking element 150 is coupled to the slide, the slide may move the distal end of the blocking element along a linear path. Responsive to increasing a fluid flow rate through the annulus towards the surface that directly interacts with blocking element 150 past a fluid flow threshold, the distal end of the blocking element 150 may move towards the stopper 130 to accumulate blocking element 150 in a spiraling shape. The accumulation of blocking element 150 may extend across annulus 140, and form a porous seal across annulus 140.

In embodiments, blocking element 150 may be a chain comprising ropes, links, formed of various shapes and sizes, such as rings, ovals, rectangles, squares, spherical, etc., wherein the links may have different lengths and widths, such as 1 millimeter to 15 centimeters. The links may be formed of different materials, such as steel, aluminum, alloys, plastics, engineered plastics, rubbers, etc. Blocking element 150 may be further linked together to form a net like shape, especially when multiple chain like materials are attached to the drill string. Other materials may also be attached to the chain like material proximal to the distal end of blocking element 150. These materials may comprise rubber sheets, rags, etc., and may be deposited on the surface of a formed plug and help to further reduce the flow.

When the fluid flow rate in annulus 140 flowing towards a surface of wellbore 120 and applied against blocking element 150 is less than a flow threshold, blocking element 150 may remain in its elongated state via gravity. When gravity is not sufficient to maintain blocking element 150 in the elongated state at rest, weighted objects may be attached to blocking element 150 to maintain the blocking element in the elongated state at rest. Furthermore, springs may be attached to blocking element 150 to assist in elongating blocking element at rest, which may be effective in horizontal wells.

Figure 2:
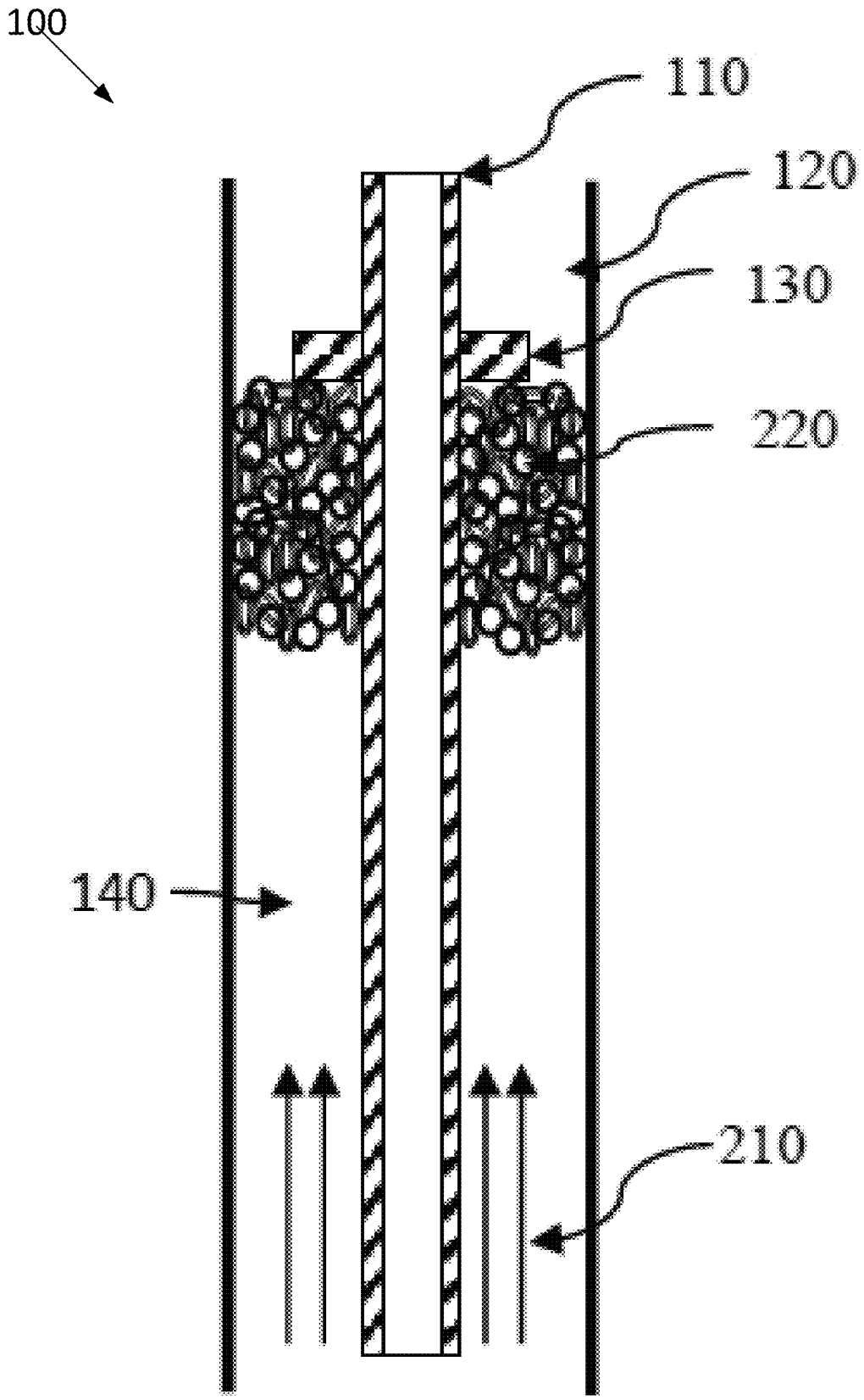
FIG. 2 depicts flow activated choke system 100 in a compacted mode, according to an embodiment.

FIG. 2 depicts flow activated choke system 100 in a compacted mode, according to an embodiment. Elements depicted in FIG. 2 may be described above, and for the sake of brevity a further description of these elements is omitted.

When the fluid flow rate in annulus 140 flowing towards the surface of wellbore 120 against blocking element 150 is greater than the flow threshold, a distal end of the blocking element 150 may travel towards due to the friction against blocking element 150. The distal end may be restricted in upper ward movement by stopper 130. Then blocking element 150 may accumulate around drill string 110 in the annulus 140. The accumulation of the blocking element 150 may form a plug across the annulus. This plug may be used to seal the annulus 140 to reduce or choke the flow of fluid towards the surface.

In embodiments, blocking element 150 may be a porous device in the compacted or elongated mode. This may allow for communication across blocking element 150 in either mode. However, in further embodiments, a lower surface of blocking element 150 may be coated with or coupled with a sealing layer, such as rubber. Responsive to the blocking element 150 moving to the compacted and accumulated mode, the lower surfaces of blocking element 150 coated with the sealing layer may form a seal across annulus 140.

A length of blocking element 150 in the compact mode may be at least as long as an effective screening length. The effective screening length may be a length that is long enough to translate an axial force applied to blocking element 150 to a radial force such that the other elements within system 100 may not be impacted by the pressure differentials across blocking element 150. Accordingly, the accumulation of the blocking element may not move due to stress relieving elements dissipating the axial force. In other words, the accumulation of blocking element 150 anchors the device at the position of the accumulation after the length of the accumulation is longer than the effective screening length. Details about the effective screening length SL can be found in this article: "Overshoot Effect in the Janssen Granular Column: A Crucial Test for Granular Mechanics" by G. Ovarlez, et al. published in Physical Review E 67(6 Pt 1): 060302, July 2003. In embodiments, the effective sealing length SL may be based on equation (1) shown below.

$$SL=R/(2KF_s) \quad (1)$$

The effective screening length may be equal to the radius (R) of wellbore 120 divided by two times the Janssen's coefficient (K) multiplied by the friction factor ($F_s$) along the inner diameter of wellbore 120. In other embodiments, the effective screening length may be based on not the radius of wellbore 120, but the width (W) of a rectangle cross sectional shape of a long hollow cavity as shown below in equation (2).

$$SL=(W/2)/(2KF_s) \quad (2)$$

As such, the effective screening length may be substantially based on the radius (or an equivalent dimension of a cross sectional area) of wellbore 120 and the friction factor of the inner wall of wellbore 120. From equations (1) and (2) presented above, it is known that increasing the roughness, irregularities, surface areas, etc. of the inner diameter of wellbore 120 may greatly increase the friction factors. When increasing the friction factors of the inner diameter of wellbore 120, the effective screening length may correspondingly decrease.

Figure 3:
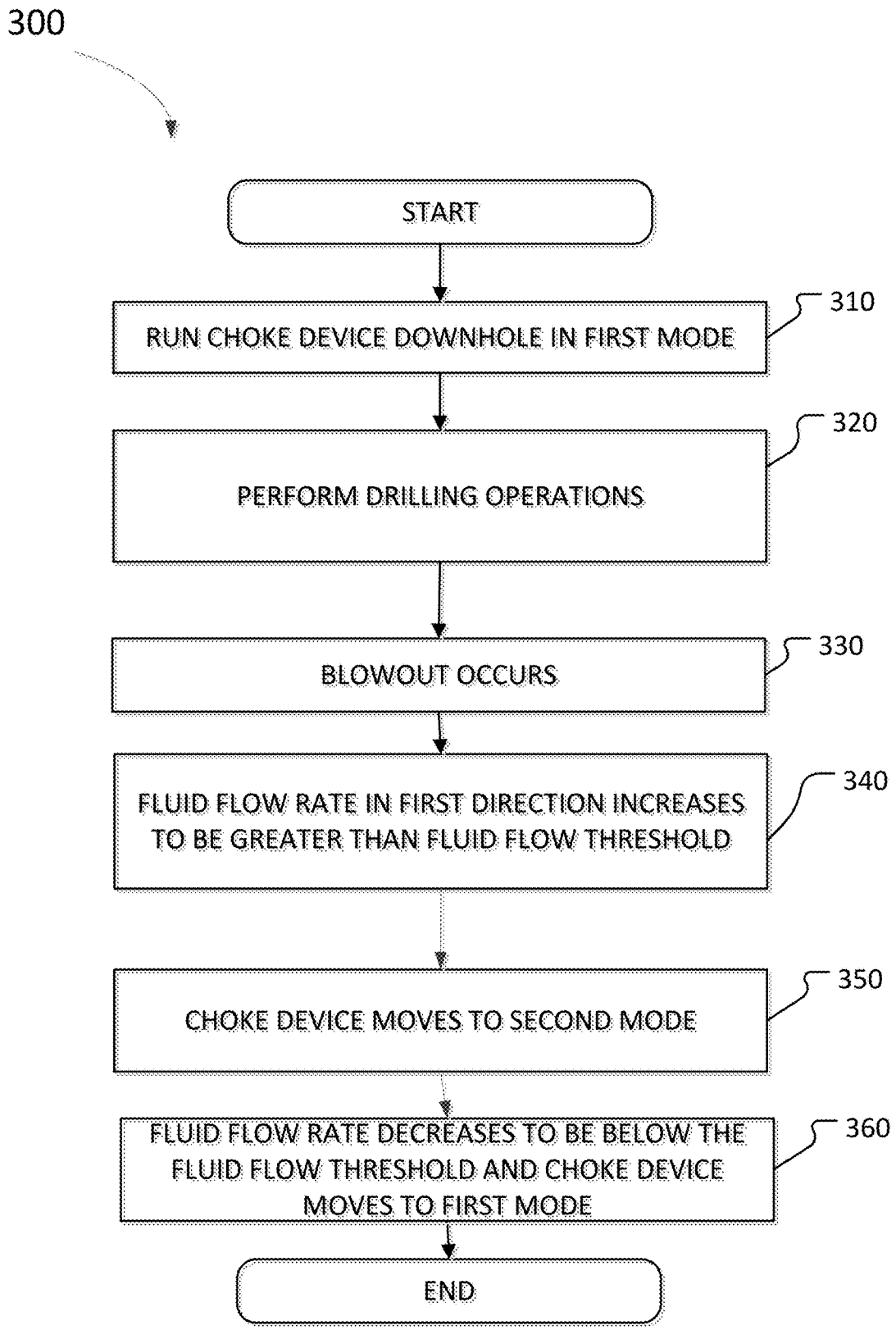
FIG. 3 depicts a method 300 utilizing a choke device, according to an embodiment.

FIG. 3 depicts a method 300 utilizing a choke device, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At operation 310, a choke device may be run in hole on a drill pipe or tubing. The choke device may be positioned downhole in an elongated state when at rest.

At operation 320, normal drilling operations may occur within an annulus between the drill pipe and the wellbore. The normal drilling operations may have a fluid flow rate from a distal end of the wellbore towards the surface of the wellbore that is less than a fluid flow threshold.

At operation 330, a blowout downstream from the choke device may occur. In other embodiments, the blowout may be any occurrence of a rapid increase in pressure downhole from the choke device.

At operation 340, a fluid flow rate from an area below the choke device towards the surface of the wellbore may increase based on the events of operation 330, such as a blowout. The fluid flow rate may increase to be greater than a fluid flow threshold.

At operation 350, responsive to the flow of fluid flowing towards the surface of the wellbore at the fluid flow rate greater than the fluid flow threshold, a blocking element may accumulate proximate to a stopper. Specifically, the flow of fluid may cause friction against the blocking element to move the blocking element. This may cause the blocking element to form a blockage across the annulus to reduce a pressure across the blocking element. As such, the blocking element may accumulate based on the direct interaction with fluid flowing against the blocking element without any human interaction.

At operation 360, the fluid flow rate may drop below the fluid flow threshold. This may cause the blocking element to automatically become elongated.

Figure 4:
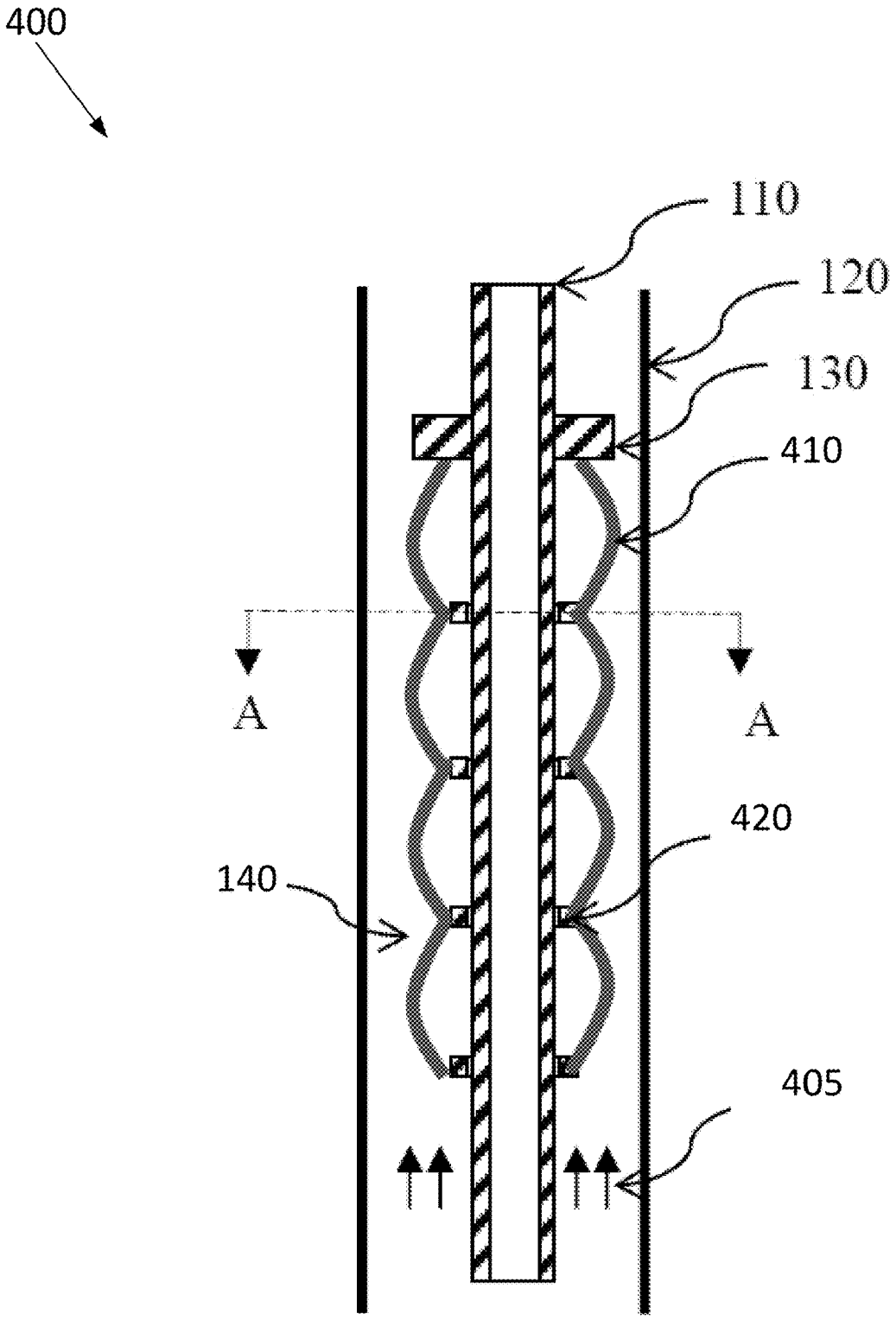
FIG. 4 depicts flow activated choke system 400 in an elongated mode, according to an embodiment.

FIG. 4 depicts flow activated choke system 400 in an elongated mode, according to an embodiment. Elements depicted in FIG. 4 may be described above, and for the sake of brevity a further description of these elements is omitted. As depicted in FIG. 4, flow activated choke system 400 may include a drill string 110, wellbore 120, stopper 130, a plurality of blocking elements 410, and guiding rings 420.

The blocking elements 410 may be arranged in series, and may be formed of skirts with fabric like material around drill string 110. The skirts may be formed of fabric, rubber sheets, plastic film, metal wire, etc. Each of the blocking elements 410 may be cylindrical in shape with a larger diameter at the center compared with the ends of each of the skirts. Alternatively, blocking element 410 may be comprised by a single, long skirt. The length and largest diameter of a skirt may be based on the annulus space or size, such that the skirt may be large enough to extend across the annulus 140 when blocking elements 410 are in a compact and accumulated mode.

In embodiments, each of blocking elements 410 may be stretched by weights, springs, etc. that is configured to apply a force towards a distal end of wellbore 140. The weights may be configured to allow blocking elements 410 to be elongated when a fluid flow rate through the annulus is below a fluid flow threshold. Yet, the weights may also be configured to allow blocking elements 410 to be compacted and accumulated responsive to the fluid flow rate through the annulus is greater than a flow threshold. When the skirts move upward towards the surface of the wellbore 140 by blocking elements 410 directly interacting with the fluid flow, the skirts may fold and accumulate at a stopper 130. When the skirts fold and accumulate enough around the drill string 110 in annulus 140, the fabric like material of the skirt can eventually seal off the annulus.

After the annulus flow rate has been controlled and becomes lower, pulling the drill string 110 may allow the folded skirts unfolded and stretched again and be in the open position. In other embodiments, the skirts may be opened by pumping down fluid into the annulus to push the folded skirt down to unfold the skirts.

Guiding rings 420 may be rings that are configured to assist in the movement of the blocking elements 410 along a linear path. Guiding rings 420 may have an inner diameter that is substantially the same as that of the outer diameter of drill string 110. Guiding rings 420 may also be configured to control the expansion of blocking elements 410 to locations between guiding rings. As such, responsive to guiding rings 420 sliding along drill string 110, guiding rings 420 may force the radial expansion of blocking elements 410.

Figure 5:
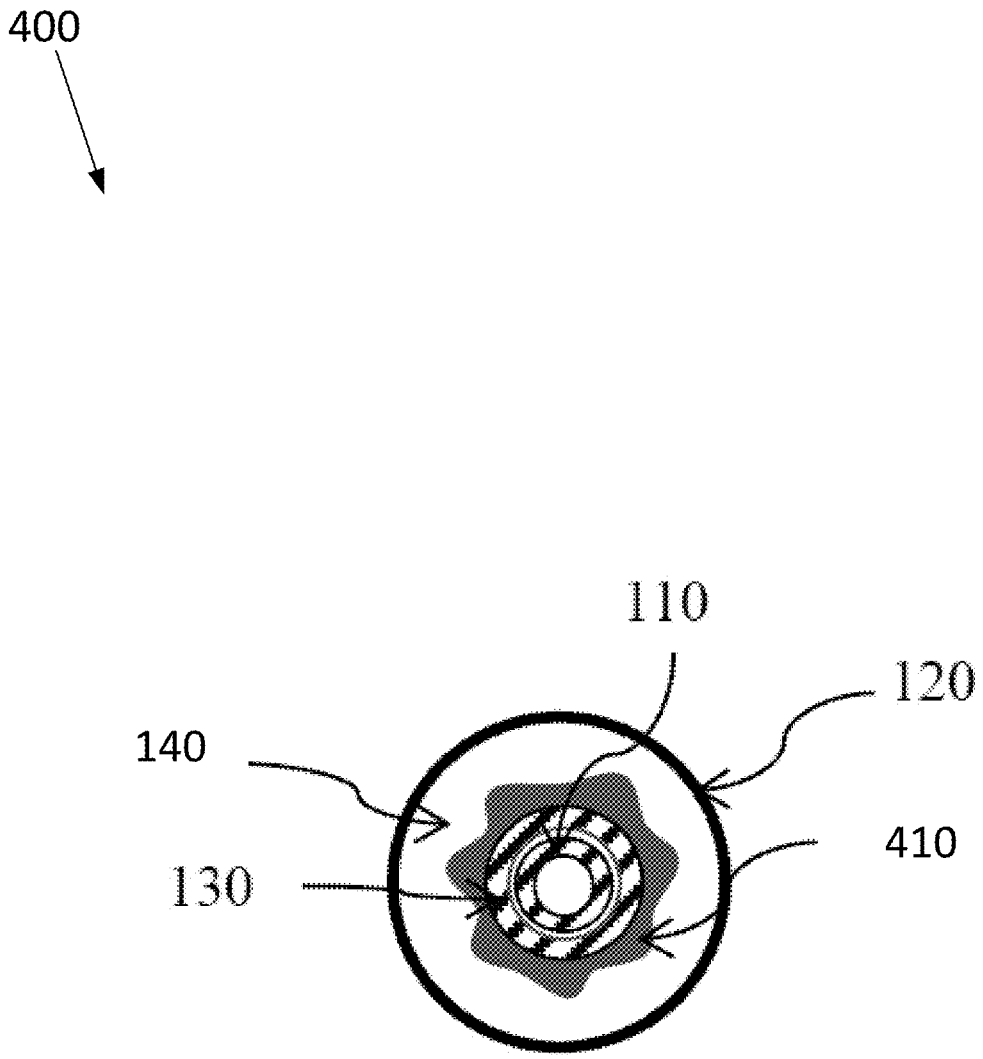
FIG. 5 depicts a cross sectional view of flow activated choke system 400 in an elongated mode, according to an embodiment.

FIG. 5 depicts a cross sectional view of flow activated choke system 400 in an elongated mode, according to an embodiment. Elements depicted in FIG. 4 may be described above, and for the sake of brevity a further description of these elements is omitted.

As depicted in FIG. 5, when blocking elements 410 are elongated there may be an annular space 140 between blocking elements 410 and wellbore 120.

Figure 6:
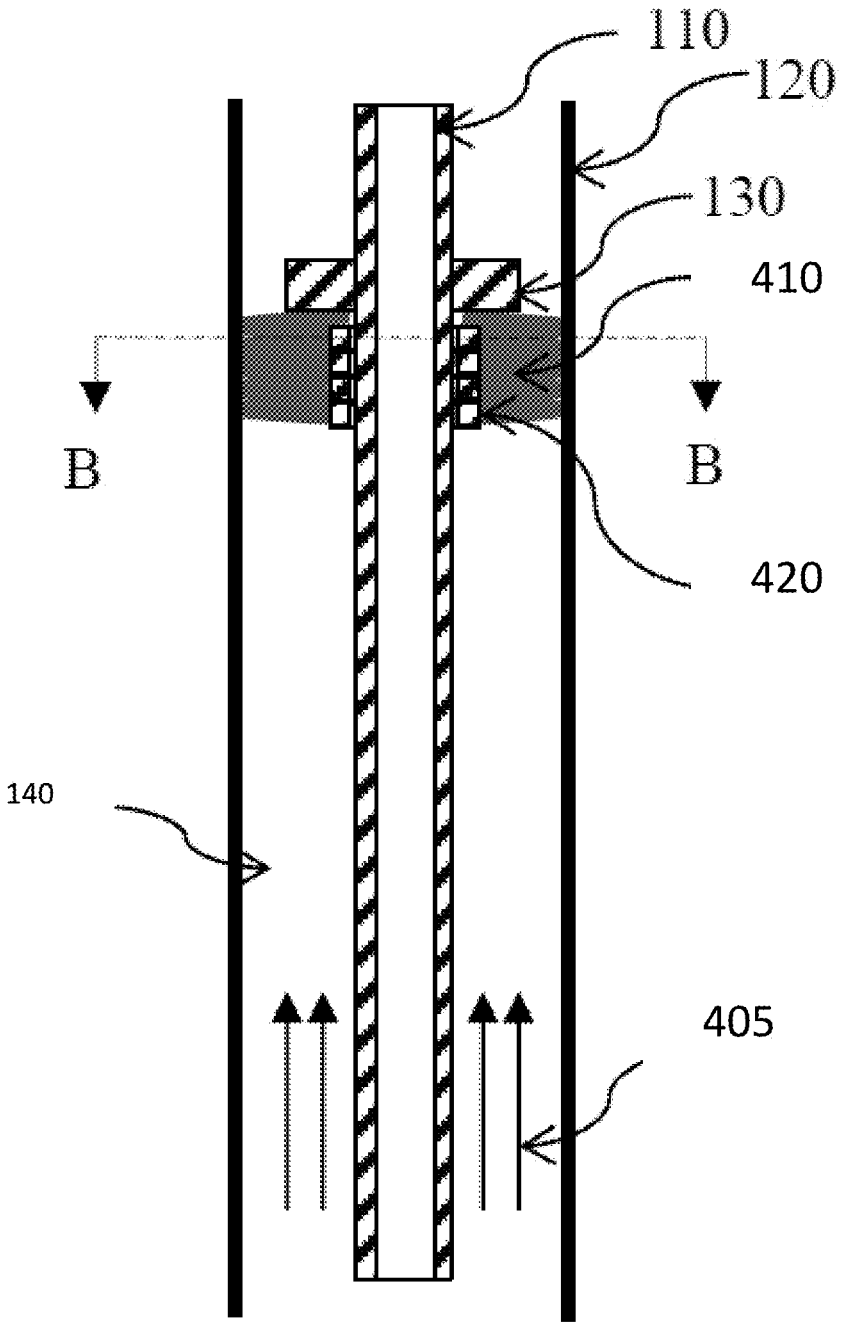
FIG. 6 depicts flow activated choke system 400 in a compressed mode, according to an embodiment.

FIG. 6 depicts flow activated choke system 400 in a compressed mode, according to an embodiment. Elements depicted in FIG. 6 may be described above, and for the sake of brevity a further description of these elements is omitted. As depicted in FIG. 6, responsive to the fluid flowing 405 in the annulus at a fluid flow rate greater than a flow rate threshold, the flowing fluid 405 may directly interact with the blocking elements 410 to shrink a length of the blocking elements 410. This may force the blocking elements to expand across the annulus 170.

Figure 7:
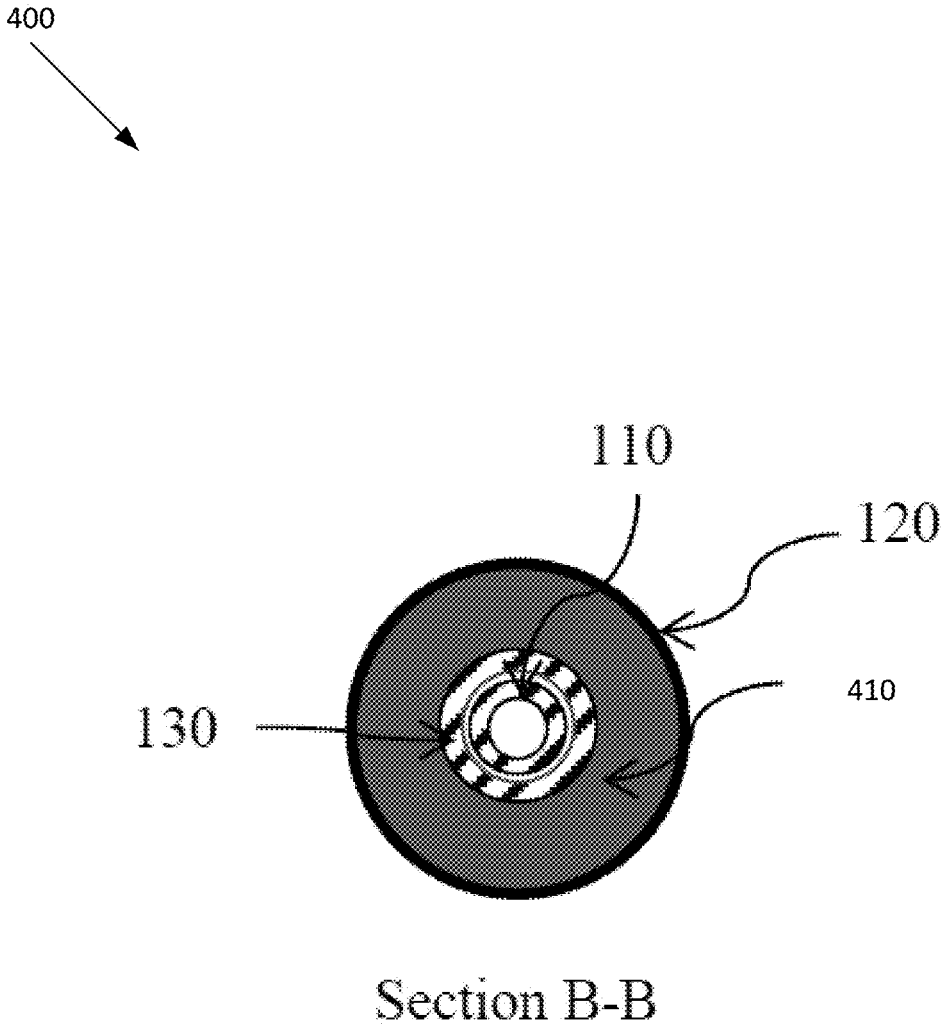
FIG. 7 depicts flow activated choke system 400 in a compressed mode, according to an embodiment.

As depicted in FIG. 7, when blocking elements 410 are accumulated around stopper 130 there may be no annular space 140 between blocking elements 410 and wellbore 120.

Figure 8:
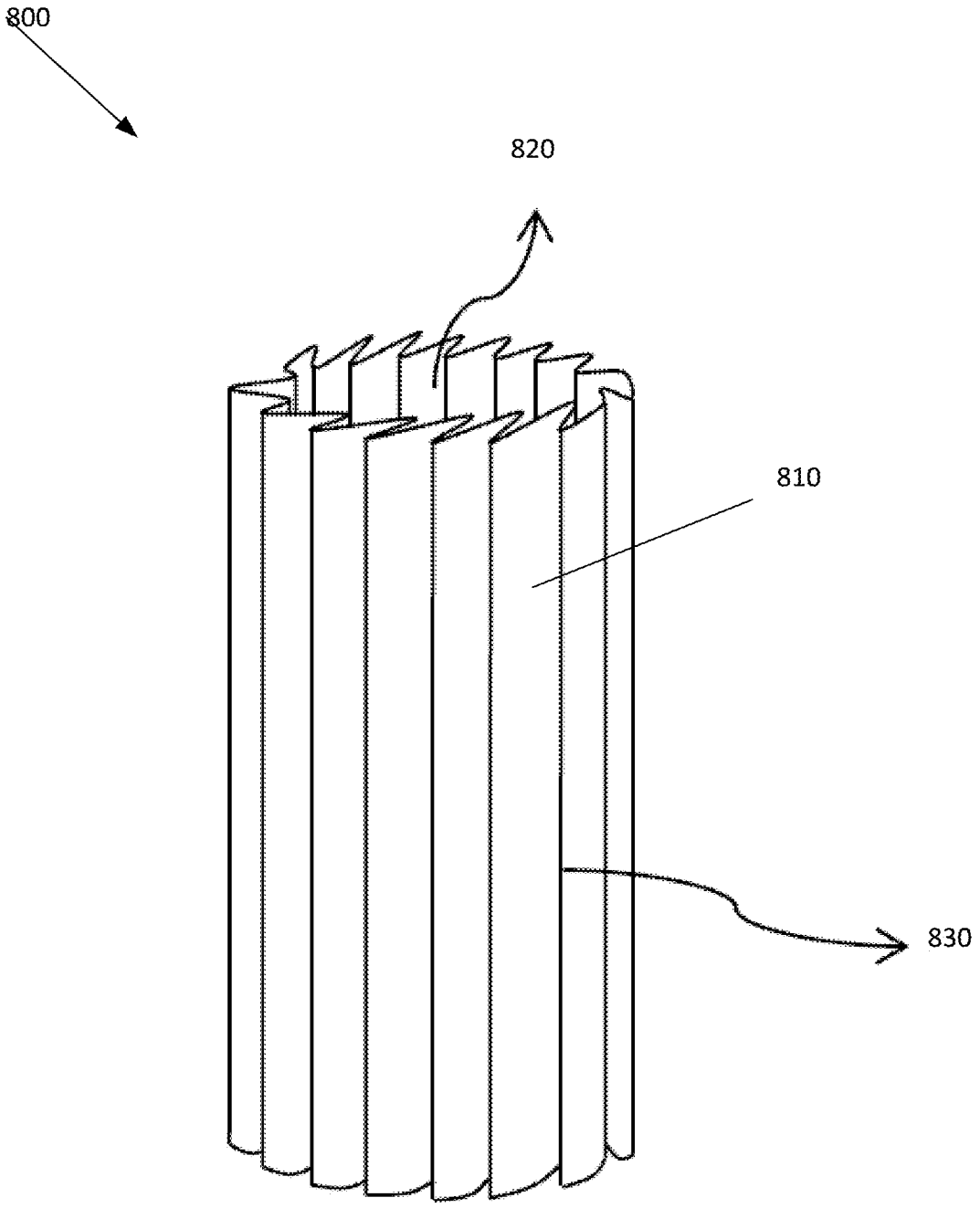
FIG. 8 depicts a blocking element 800, according to an embodiment.

FIG. 8 depicts a blocking element 800, according to an embodiment. Elements depicted in FIG. 8 may be described above, and for the sake of brevity a further description of these elements is omitted. Blocking element 800 may be a skirt with a longer longitudinal axis 820 when stretched, and a shorter longitudinal axis 810 when compressed. Blocking element 800 may include a plurality of pleats 820 that extend along a longitudinal axis 820 of blocking element 800. The plurality of pleats may increase the surface area of blocking element 800, and allow portions of blocking element 800 to be folded over itself when stretched.

Figure 9:
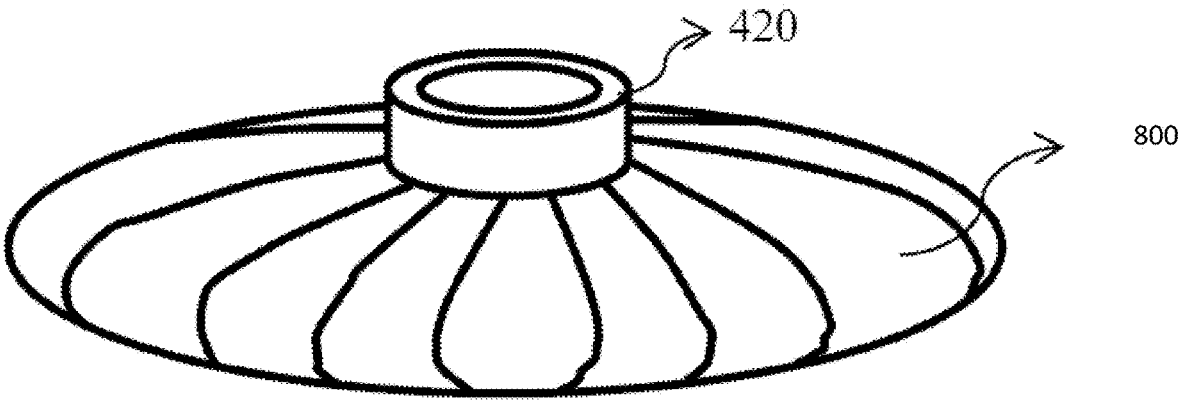
FIG. 9 depicts a blocking element 800, according to an embodiment.

FIG. 9 depicts a blocking element 800, according to an embodiment. Elements depicted in FIG. 9 may be described above, and for the sake of brevity a further description of these elements is omitted. As depicted in FIG. 9, responsive to fluid flowing around blocking element 800, guiding ring 420 may aide in the compression and/or folding of blocking element 800.

Figure 10:
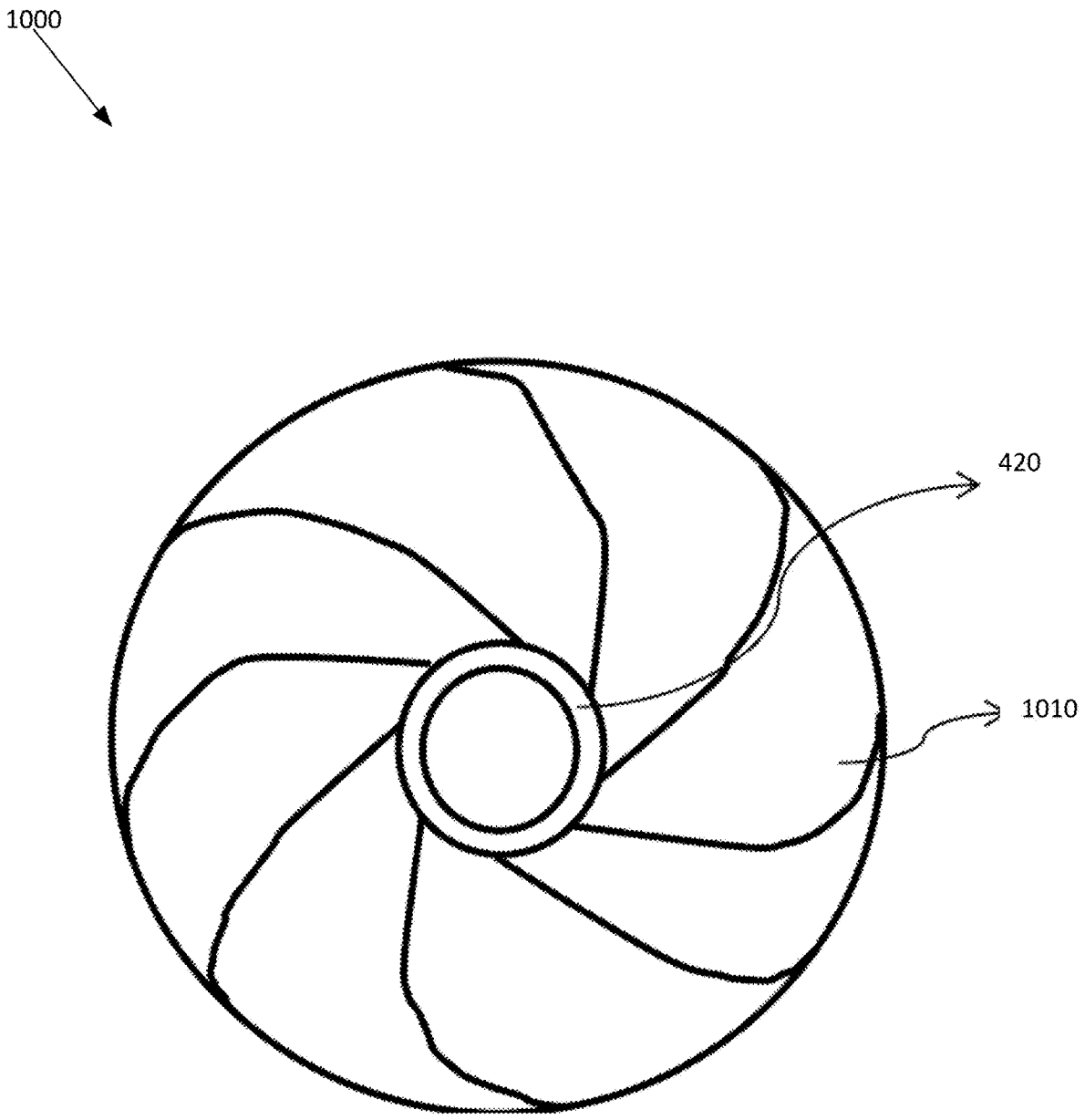
FIG. 10 depicts a blocking element 1000, according to an embodiment.

FIG. 10 depicts a blocking element 1000, according to an embodiment. Elements depicted in FIG. 10 may be described above, and for the sake of brevity a further description of these elements is omitted. As depicted in FIG. 10, responsive to fluid flowing around blocking element 1000, guiding ring 420 may aide in the compression and/or folding of blocking element 1000.

As depicted in FIG. 10, blocking element 1000 may include a plurality of skirts that have a larger outer diameter than inner diameter when expended. This may be due to pleats or other folding mechanisms that allow blocking element 1000 to have a much smaller outer diameter when stretched in compared to when blocking element 1000 is compressed.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation may be combined with one or more features of any other implementation.

What is claimed is:

1. A system with a choke device, the system comprising:
a wellbore;
a drill string positioned within the wellbore;
an annulus between the wellbore and the drill string;
a stopper positioned between the drill string and the wellbore, the stopper being configured to reduce a space of the annulus;
a blocking element with a proximal end and a distal end, the proximal end of the blocking element being coupled with a lower surface of the stopper, the distal end being configured to move towards the stopper based on a fluid flow rate in a first direction within the annulus being greater than a fluid flow rate threshold and the fluid directly interacting with the blocking element to move the distal end of the blocking element, wherein the first direction is towards a surface of the wellbore, wherein the blocking element includes a plurality of links, wherein the plurality of links are elongated when the fluid flow rate is less than the fluid flow rate threshold, and the plurality of links are accumulated at the stopper when the fluid flow rate is greater than the fluid flow rate threshold, wherein the blocking element of accumulated plurality of links is porous.

2. The system of claim 1, wherein the plurality of links are spiraled around the drill string when the plurality of links are elongated and when the plurality of links are accumulated.

3. The system of claim 1, wherein the stopper is positioned on an inner diameter of a wellbore wall.

4. The system of claim 1, wherein the stopper is positioned on an outer diameter of the drill string.

5. The system of claim 1, wherein an increase of the fluid flow rate being greater than the fluid flow rate threshold is caused by a blowout between the blocking element and an end of the wellbore.

6. A system with a choke device, the system comprising:
a wellbore;
a drill string positioned within the wellbore;
an annulus between the wellbore and the drill string;
a stopper positioned between the drill string and the wellbore, the stopper being configured to reduce a space of the annulus;
a blocking element with a proximal end and a distal end, the proximal end of the blocking element being coupled with a lower surface of the stopper, the distal end being configured to move towards the stopper based on a fluid flow rate in a first direction within the annulus being greater than a fluid flow rate threshold and the fluid directly interacting with the blocking element to move the distal end of the blocking element, wherein the first direction is towards a surface of the wellbore, wherein the blocking element includes a plurality of links, wherein the distal end the plurality of links configured to move along a linear path.

7. A method associated with a choke device, the method comprising:
positioning a drill string within a wellbore, wherein an annulus is formed between the wellbore and the drill string;
positioning a stopper between the drill string and the wellbore, the stopper reducing a space of the annulus;
coupling a proximal end of a blocking element with a lower surface of the stopper;
increasing a fluid flow rate within the annulus to be above a fluid flow rate, wherein the fluid flow rate is in a first direction, the first direction is towards a surface of the wellbore;
moving a distal end of the blocking element towards the stopper based on the fluid flow rate in the first direction being greater than a fluid flow rate threshold, wherein the fluid directly interacts with the blocking element to move the distal end of the blocking element, wherein the blocking element includes a plurality of links;
elongating the plurality of links when the fluid flow rate is less than the fluid flow rate threshold; and
accumulating the plurality of links at the stopper when the fluid flow rate is greater than the fluid flow rate threshold, wherein the blocking element of accumulated plurality of links is porous.

8. The method of claim 7, wherein the space within the annulus at a position corresponding to the stopper is less than a length of some of the plurality of links.

9. The method of claim 7, further comprising:
spiraling the plurality of links around the drill string when the plurality of links are elongated and when the plurality of links are accumulated.

10. The method of claim 7, further comprising:
positioning the stopper on an inner diameter of a wellbore wall.

11. The method of claim 10, further comprising:
positioning the stopper on an outer diameter of the drill string.

12. The method of claim 7, further comprising:
moving the distal end of the plurality links along a linear path.

13. The method of claim 7, wherein an increase of the fluid flow rate being greater than the fluid flow rate threshold is caused by a blowout between the blocking element and an end of the wellbore.

14. The method of claim 7, further comprising:

coupling weights to the distal end of the blocking element.

* * * * *